US012569016B2

(12) United States Patent
Abnoosi

(10) Patent No.: US 12,569,016 B2
(45) Date of Patent: Mar. 10, 2026

(54) BODY ENERGY BALANCE ASSEMBLY EMPLOYING EARTH'S MAGNETIC FIELD AND ASSOCIATED METHODS

(71) Applicant: MANA Clinical LLC, Paradise Valley, AZ (US)

(72) Inventor: Fatemeh Tina Abnoosi, Paradise Valley, AZ (US)

(73) Assignee: MANA CLINICAL LLC, Paradise Valley, AZ (US)

( * ) Notice: Subject to any disclaimer, the term of this patent is extended or adjusted under 35 U.S.C. 154(b) by 0 days.

(21) Appl. No.: 18/826,232

(22) Filed: Sep. 6, 2024

(65) Prior Publication Data

US 2025/0082051 A1 Mar. 13, 2025

Related U.S. Application Data

(60) Provisional application No. 63/537,650, filed on Sep. 11, 2023.

(51) Int. Cl.
*A41D 19/00* (2006.01)
*A41D 20/00* (2006.01)

(52) U.S. Cl.
CPC ..... *A41D 19/0024* (2013.01); *A41D 19/0037* (2013.01)

(58) Field of Classification Search
CPC ..... A41D 19/0024; A41D 19/0037
See application file for complete search history.

(56) References Cited

U.S. PATENT DOCUMENTS 5,865,783 A * 2/1999 Klimoski ..... A61F 13/104 602/22
9,671,165 B1 * 6/2017 Quinn ..... A47K 10/02
11,598,606 B2 * 3/2023 Strzalko ..... F41C 33/0218
2003/0197042 A1 * 10/2003 Warren ..... A45C 1/04 224/183
2007/0028353 A1 * 2/2007 Bosnakovic ..... A41D 19/01594 2/160
2010/0262047 A1 * 10/2010 Genis ..... A61B 5/1124 601/5
2011/0220817 A1 * 9/2011 Moore ..... A61N 1/16 250/505.1
2012/0081884 A1 * 4/2012 Gonzalez ..... F21V 23/0407 362/103
2013/0326789 A1 * 12/2013 Lehrman ..... A41D 19/0034 2/160
2015/0309563 A1 * 10/2015 Connor ..... A61B 5/1071 73/865.4
2016/0278460 A1 * 9/2016 Hunter ..... A41F 1/002
2016/0317855 A1 * 11/2016 Rolls ..... A01K 27/006
(Continued)

OTHER PUBLICATIONS https://srkfebeolnxumd.blogspot.com/2021/06/arteries-diagram-arm-wiring-and-diagram.html; "Arteries Diagram Arm . . . "; Jun. 16, 2021 (Year: 2021).*

*Primary Examiner* — Robert H Muromoto, Jr.
(74) *Attorney, Agent, or Firm* — XSENSUS LLP

(57) ABSTRACT

An assembly includes a magnet, a pouch into which the magnet is provided, and sand in the pouch that embeds the magnet. The assembly is to be used in an open palm with the north-south poles of the magnet being parallel to arteries in the open palm and positioning the open palm parallel to the ground. The pouch may be integrated into a wearable hand covering that properly aligns the magnet with the palm of a user when worn.

19 Claims, 5 Drawing Sheets

(56) References Cited

U.S. PATENT DOCUMENTS

| | | | | |
|---|---|---|---|---|
| 2016/0346895 | A1* | 12/2016 | Dorf | B24B 7/20 |
| 2017/0354816 | A1* | 12/2017 | Huelman | A61N 1/0484 |
| 2018/0049491 | A1* | 2/2018 | Cook | A41D 19/01523 |
| 2023/0158379 | A1* | 5/2023 | Hong | A63B 57/20 206/315.1 |
| 2023/0285217 | A1* | 9/2023 | Dillard | A61H 3/00 |
| 2025/0064153 | A1* | 2/2025 | Lawrence | A41D 1/04 |

* cited by examiner

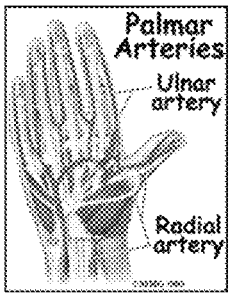
FIG. 1
FIG. 2A
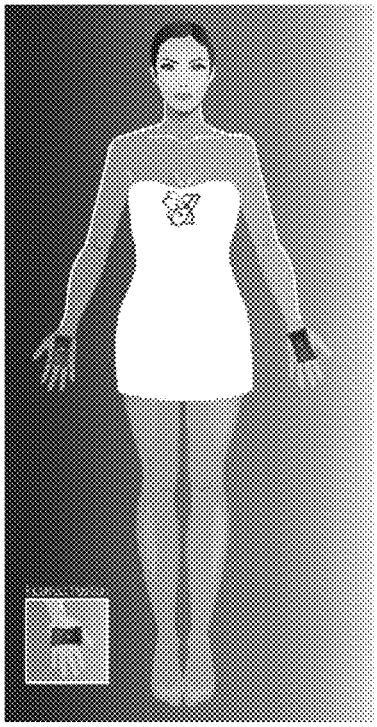
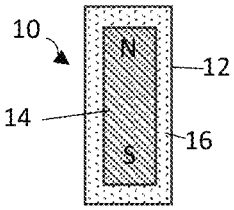
FIG. 2B
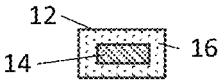
FIG. 2C

BODY ENERGY BALANCE ASSEMBLY EMPLOYING EARTH'S MAGNETIC FIELD AND ASSOCIATED METHODS

CROSS-REFERENCE TO RELATED APPLICATION

The present application claims priority to Provisional Ser. No. 63/537,650 filed on Sep. 11, 2023.

BACKGROUND

Due to many issues experienced around the world with the use of electronics, sitting for prolonged periods of time, lack of movement, and poor nutrition, there is a need for a device to help the body create its own needed supplements. Embodiments are designed to create a level of energy in the body. Although the design is simple and uses the same product, once it is coupled with body and earth magnetic field it creates a very personalized envelope of energy that is very specific to that person.

SUMMARY

Embodiments relate to using an assembly having a magnet with low force embedded in sand, e.g., ocean sands, wrapped in a pouch, e.g., of a natural fiber. Such an assembly provides a small amount of magnetic field to direct the circulating energy in the palm of the hand. By placing one of each assembly at the palm of each hand, the created magnetic field helps adjust the magnetic field of the body and attune it with earth magnetic field.

BRIEF DESCRIPTION OF THE DRAWINGS

The scope of the present disclosure is best understood from the following detailed description of exemplary embodiments when read in conjunction with the accompanying drawings.

FIG. 1 illustrates a palm of hand showing the arteries therein.

FIG. 2A illustrates an assembly in use.

FIG. 2B illustrates a top cross-section of the assembly.

FIG. 2C illustrates a side cross-section of the assembly.

DETAILED DESCRIPTION

Figure 3A:
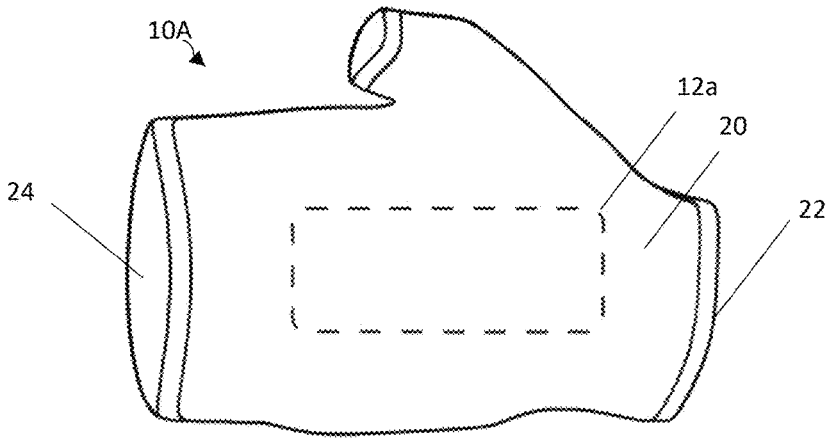
FIG. 3A illustrates top view of an assembly according to a first embodiment.

Embodiments use an assembly having a magnet with low force embedded in sand, e.g., ocean sands, wrapped in a pouch, e.g., of a natural fiber. Such an assembly provides a small amount of magnetic field to direct the circulating energy in the palm of the hand. By placing one of each assembly at the palm of each hand, the created magnetic field helps adjust the magnetic field of the body and attune it with earth magnetic field.

The earth magnetic field running at 0.045 micro-Tesla is essential to keep our body together, however mental, sickness and physical misalignments causes the body not to respond to this field as it should manifesting itself in issues with health and mental disorder.

FIG. 1 illustrates a palm of hand, which shows that both arteries are intertwined in the palm making it the most important part of the body for balancing the blood where it circulates through the body therefore balancing the body in whole. The blood has iron that is attracted to a magnet by having the North and South pole of magnet respectively placed as the blood enters and leaves the palm of the hand. The placement of the hand must be in parallel to the earth coupling the magnetic field of earth with one initiated on the palm of the hand supporting the energy flow. Otherwise, it does not matter where the North and South are positioned as long as the north-south poles aligned as shown.

The human body generates diverse electrical activity in a variety of cell types. This comprises neurons, endocrine cells, and muscle cells, many of which are referred to as "excitable cells." This action generates a magnetic field, as does all electricity. This electric current in the body generates an electromagnetic field. Because the human body, and every living organism on this planet, is an electrical body all made up of charged particles, it is also subject to the laws of electromagnetism. However, every human being operates at its own magnetic field as it is truly dependent on biochemistry, and electrical field of individual.

FIG. 2A illustrates an assembly 10 in use. FIG. 2B illustrates a top cross-section of the assembly 10. FIG. 2C illustrates a side cross-section. As may be seen therein, the assembly 10 according to embodiments uses a magnet 14 arranged to have the north and south pole respectively from the tip of the fingers to the wrist and is embedded in, e.g., completely surrounded by, sand, e.g., ocean sand, 16 in a pouch 12 to allow for proper amount of separation between the magnet and the body. The sand needs to be packed densely enough so that the magnet 14 does not move. The features of using the specific magnet is as follows:

Placed on the palm of the hand. Proper placement is shown in FIG. 2A and improper placement is shown in the inset of FIG. 2A. Position and alignment of the magnet onto the hand should be controlled such that the two radial and ulnar arteries are covered. The individual can be laying down or sitting with their hands open. The hands are to be held parallel to the ground.

The time of the treatment is important as a scheduled time to perform yield in a better result, e.g., consistent, e.g., every other night for 3-10 minutes before bedtime. If menstruating, reduce the time by half. The eyes should be closed.

Figure 3B:
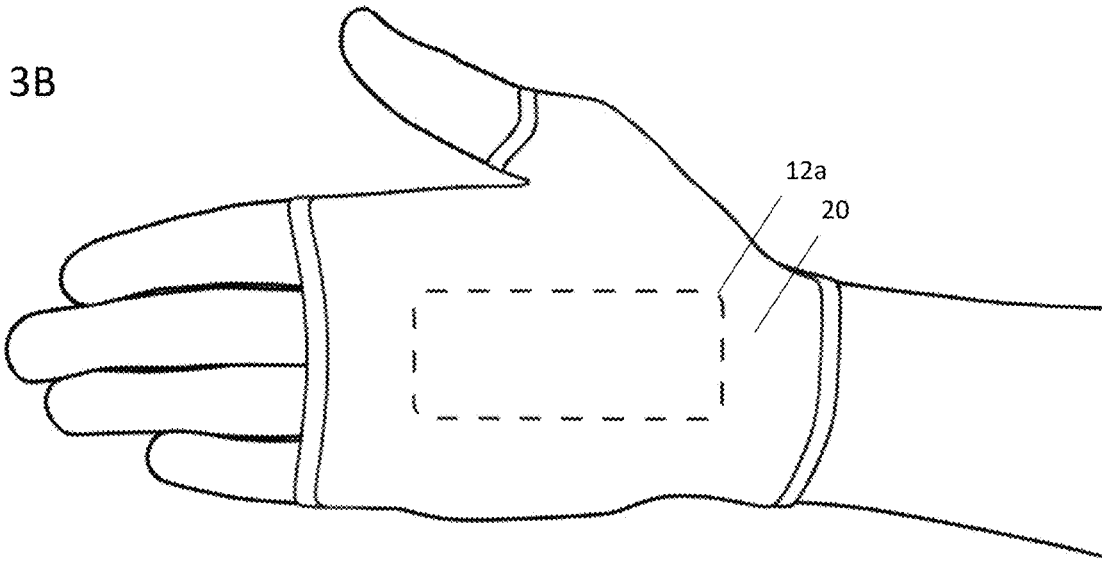
FIG. 3B illustrates top view of the assembly of FIG. 3A in use.
Figure 4A:
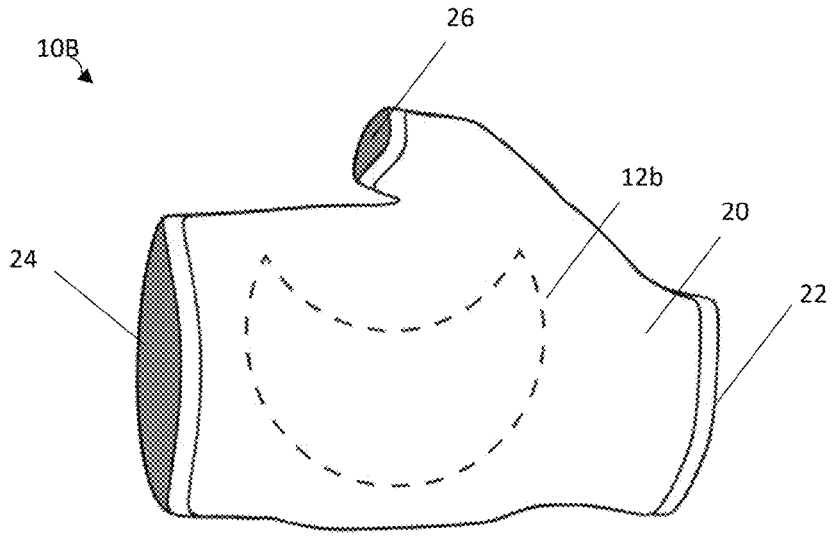
FIG. 4A illustrates top view of an assembly according to a second embodiment.
Figure 4B:
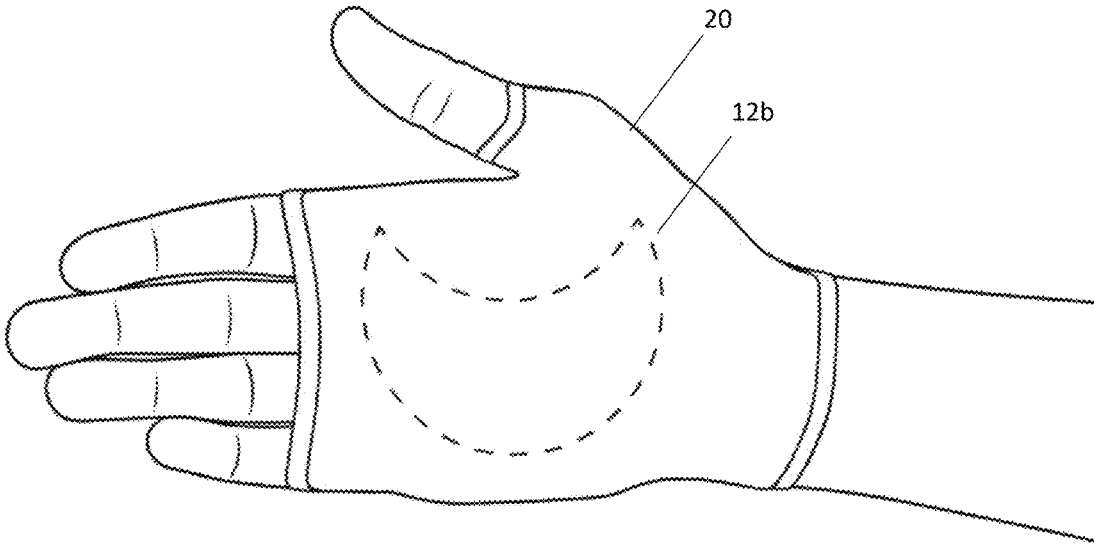
FIG. 4B illustrates the assembly of FIG. 4A in use.
Figure 5A:
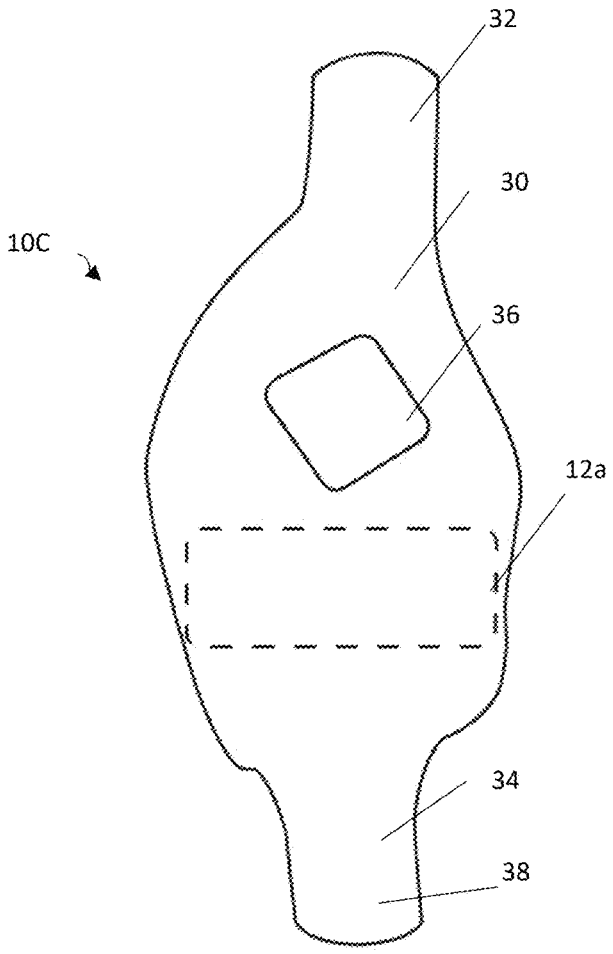
FIG. 5A illustrates top view of an assembly according to a third embodiment.
Figure 5B:
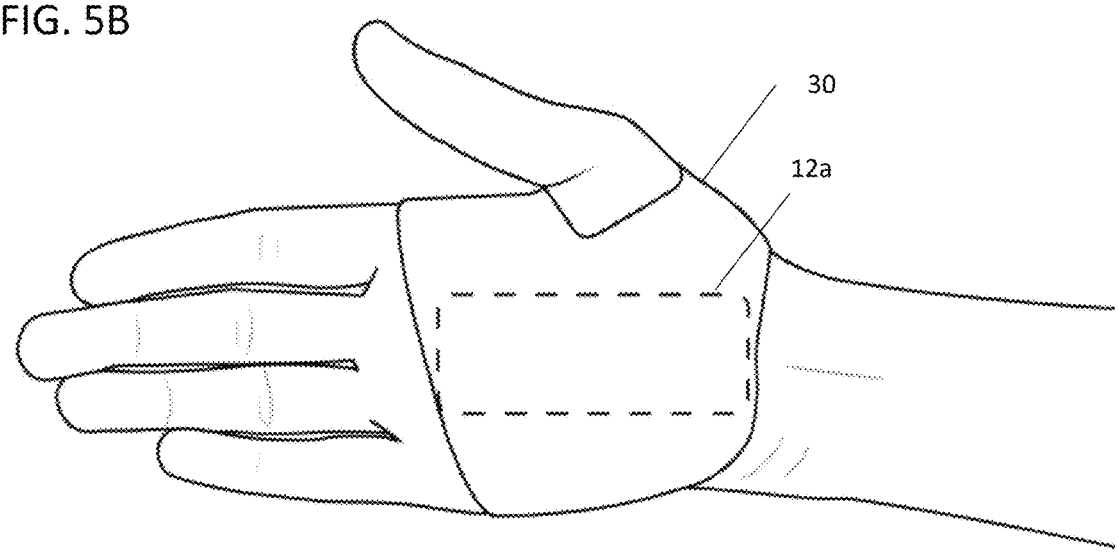
FIG. 5B illustrates the assembly of FIG. 5A in use.
Figure 6A:
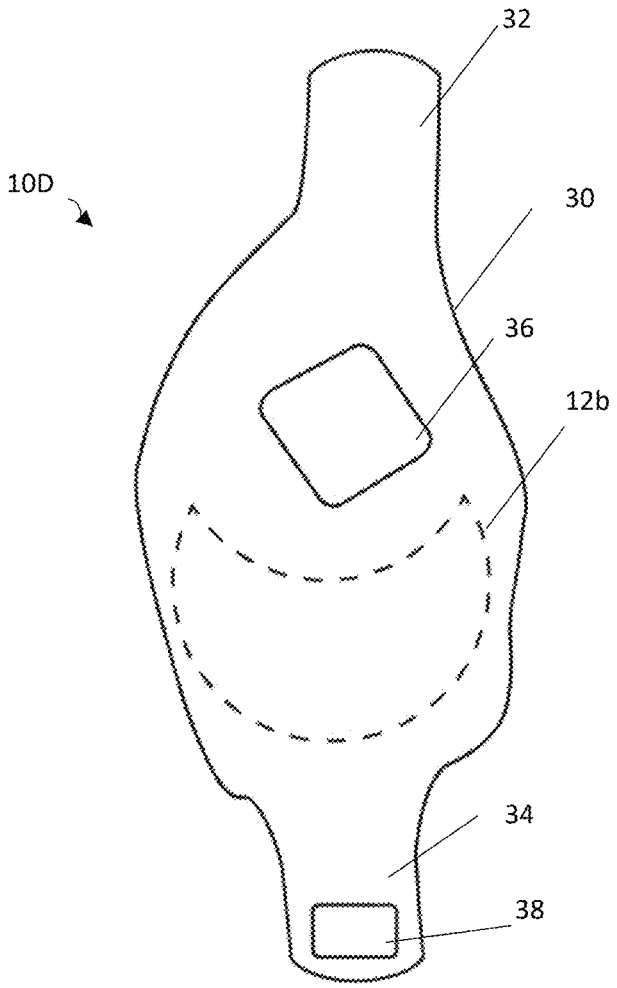
FIG. 6A illustrates top view of an assembly according to a fourth embodiment.
Figure 6B:
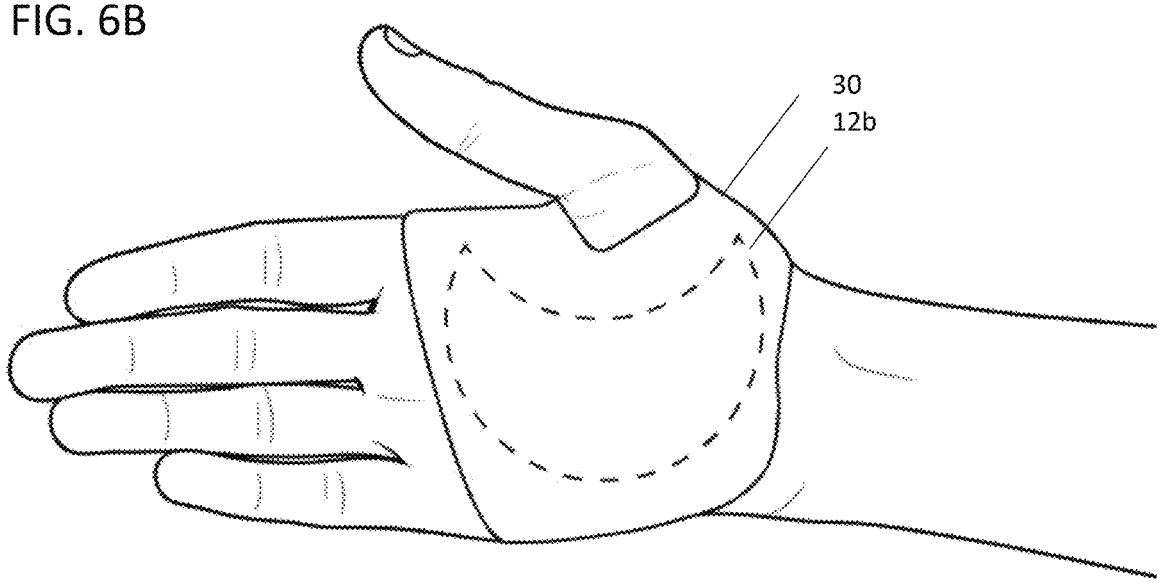
FIG. 6B illustrates the assembly of FIG. 6A in use.

While the assembly 10 shown in FIG. 2 includes just the pouch 12, the shape of the assembly 10 that includes a pouch 12 for holding the magnet 14 embedded in the sand 16 does not play an important role, as different shapes can be implemented, as illustrated in FIGS. 3A to 6B, particularly with a wearable hand covering 20 or 30 that ensures that the magnet 14 is oriented properly in the palm of a user. The material of at least the pouch 12 holding the magnet 14 should be a natural fiber, e.g., cotton, without any nylon, rayon, or polyester. The remainder of the wearable hand covering 20 or 30 may be the same material or another material. The pouch 12 may have a same shape as the magnet 12, as shown in FIGS. 3A to 6B. In particular, FIGS. 3A to 4B illustrate an assembly having a fingerless mitten 20 as the wearable hand covering, while FIGS. 5A to 6B illustrate an assembly having a palm wrap 30 with a thumbhole, both of which will insure proper placement of the magnet 14. Further, the shape of the magnet may be variously configured, as long as the magnet sufficiently covers the palm. In particular, assemblies 10A and 10C of FIGS. 3A, 3B, 5A, and 5B illustrate a rectangular magnet, while FIGS. 4A, 4B, 6A, and 6B illustrate a crescent shaped magnet.

As shown in FIGS. 3A to 4B, the fingerless mitten 20 includes a wrist opening 22, a finger opening 24, and a thumb opening 26, such that the magnet 14 in the pouch 12*a* or 12*b* is properly oriented on the palm. As shown in FIGS. 5A to 6B, the palm wrap 30 includes a first end 32, a second end 34, and a thumbhole 36. At least one of the first and second ends may include a reusable fastener 38 for securing the first and second ends together. The fastener 38 may be a reusable adhesive, a hook and loop fastener, a button, a buckle, a clip, a snap, and so forth. For a fastener 38 that uses mating connectors, corresponding connectors are provided on respective ones of the first and second ends. Alternatively, to the fingerless mitten 20 and the palm wrap 30, a fingerless glove, a palm wrap without a thumbhole, or any other wearable hand covering that properly orients the magnet 14 may be used.

The sand 16 may have the following elements within the ranges noted in the Table below to complement the magnetic properties of the application and offer a proper pathway for the energy to flow.

TABLE

| | | |
|---|---|---|
| Aluminium (%) | 3.96 | 3.26 |
| Silicon (%) | 37.88 | 42.75 |
| Potassium (%) | 1.20 | 0.97 |
| Calcium (%) | 0.87 | 0.73 |
| Titanium (%) | 0.20 | 0.43 |
| Iron (%) | 1.29 | 1.03 |
| Vanadium (ppm) | 49.6 | 63.8 |
| Chromium (ppm) | 69.1 | 37.1 |
| Manganese (ppm) | 246.8 | 215.0 |
| Cobalt (ppm) | 4.4 | 3.5 |
| Nickel (ppm) | 27.0 | 18.7 |
| Zine (ppm) | 27.6 | 24.3 |

When the product is placed in the palm properly, a small magnetic field coupling with the body natural magnetic field will be generated while also coupling to the earth magnetic field. Creating an influx of energy running through the palm of the hands using the blood flow to distribute evenly through the body through the exercise of blood flow. The benefits include better sleep, reduced pain, insomnia, shaking off unwanted habits and waking up to energized and focused days.

The present disclosure is not limited to only the above-described embodiments, which are merely exemplary. It will be appreciated by those skilled in the art that the disclosed systems and/or methods can be embodied in other specific forms without departing from the spirit of the disclosure or essential characteristics thereof. The presently disclosed embodiments are therefore considered to be illustrative and not restrictive. The disclosure is not exhaustive and should not be interpreted as limiting the claimed invention to the specific disclosed embodiments. In view of the present disclosure, one of skill in the art will understand that modifications and variations are possible in light of the above teachings or may be acquired from practicing of the disclosure.

The scope of the invention is indicated by the appended claims, rather than the foregoing description.

The invention claimed is:

1. An assembly comprising:

a magnet having north and south poles;

a pouch into which the magnet is provided; and sand in the pouch that embeds the magnet, wherein the assembly is configured such that when placed on a palm of a user with the north-south poles of the magnet aligned with arteries in the palm and with the palm held parallel to the ground, a magnetic field of the assembly couples with a magnetic field of a body of the user and an earth magnetic field.

2. The assembly according to claim 1, wherein the magnet covers a palm of a user.

3. The assembly according to claim 1, wherein the pouch is made of a natural fiber.

4. The assembly according to claim 1, wherein the pouch does not include any nylon, rayon, or polyester.

5. The assembly according to claim 1, wherein the pouch is integrated into a wearable hand covering that properly aligns the magnet with the palm of a user when worn.

6. The assembly according to claim 5, wherein the wearable hand covering is a fingerless mitten.

7. The assembly according to claim 5, wherein the wearable hand covering is a palm wrap.

8. The assembly according to claim 7, wherein the palm wrap includes a fingerhole.

9. The assembly according to claim 2, wherein the pouch is made of a natural fiber.

10. The assembly according to claim 2, wherein the pouch does not include any nylon, rayon, or polyester.

11. The assembly according to claim 2, wherein the pouch is integrated into a wearable hand covering that properly aligns the magnet with the palm of a user when worn.

12. The assembly according to claim 11, wherein the wearable hand covering is a fingerless mitten.

13. The assembly according to claim 11, wherein the wearable hand covering is a palm wrap.

14. The assembly according to claim 13, wherein the palm wrap includes a fingerhole.

15. The assembly according to claim 11, wherein the pouch and the wearable hand covering are made of a same material.

16. A therapeutic method, comprising;

placing an assembly of claim 1 in an open palm with the north-south poles of the magnet being parallel to arteries in the open palm;

positioning the open palm parallel to the ground; and maintaining the assembly on the open palm for a period of between 3 and 10 minutes.

17. The therapeutic method according to claim 16, further comprising closing eyes of the user while maintaining the assembly on the open palm.

18. The assembly according to claim 1, wherein the sand is ocean sand.

19. The assembly according to claim 1, wherein the sand is packed densely within the pouch such that the magnet is substantially prevented from moving.

* * * * *